US006866978B2

(12) United States Patent
Iida et al.

(10) Patent No.: US 6,866,978 B2
(45) Date of Patent: Mar. 15, 2005

(54) TONER FOR DEVELOPING AN ELECTROSTATIC LATENT IMAGE, DEVELOPER, DEVELOPER UNIT, AND METHOD FOR FORMING AN IMAGE

(75) Inventors: Yoshifumi Iida, Minamiashigara (JP); Suk Kim, Minamiashigara (JP); Masanori Ichimura, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/987,413

(22) Filed: Nov. 14, 2001

(65) Prior Publication Data

US 2003/0036012 A1 Feb. 20, 2003

(30) Foreign Application Priority Data

Apr. 18, 2001 (JP) ..... 2001-119749

(51) Int. Cl.[7] ..... G03G 9/09
(52) U.S. Cl. ..... 430/108.6; 430/110.4
(58) Field of Search ..... 430/108.6, 111.35, 430/111.31, 110.4

(56) References Cited

U.S. PATENT DOCUMENTS

| | | | | | |
|---|---|---|---|---|---|
| 4,855,204 | A | * | 8/1989 | Fujii et al. | 430/108.6 |
| 4,943,506 | A | * | 7/1990 | Demizu et al. | 430/108.6 |
| 4,956,258 | A | * | 9/1990 | Watanabe et al. | 430/109.3 |
| 4,985,327 | A | * | 1/1991 | Sakashita et al. | 430/110.4 |
| 5,518,849 | A | * | 5/1996 | Sato et al. | 430/111.31 |
| 5,821,023 | A | * | 10/1998 | Shibuya et al. | 430/108.6 |
| 5,922,500 | A | * | 7/1999 | Iida et al. | 430/108.6 |
| 5,994,015 | A | * | 11/1999 | Vail | 430/111.35 |
| 6,077,640 | A | * | 6/2000 | Komai et al. | 430/108.6 |
| 2002/0022190 | A1 | * | 2/2002 | Iizuka et al. | 430/110.4 |

FOREIGN PATENT DOCUMENTS

| | | |
|---|---|---|
| JP | A 60-136755 | 7/1985 |
| JP | A 60-186844 | 9/1985 |
| JP | A 61-080161 | 4/1986 |
| JP | A 61-080162 | 4/1986 |
| JP | A 61-080163 | 4/1986 |
| JP | A 64-013560 | 1/1989 |
| JP | A 64-018150 | 1/1989 |
| JP | A 02-079862 | 3/1990 |
| JP | A 05-072797 | 3/1993 |
| JP | A 05-107798 | 4/1993 |
| JP | A 05-158283 | 6/1993 |
| JP | A 05-204183 | 8/1993 |
| JP | A 10-260554 | 9/1998 |
| JP | A 2000-056514 | 2/2000 |

OTHER PUBLICATIONS

Diamond, Arthur S. (editor) Handbook of Imaging Materials. New York: Marcel–Dekker, Inc. (1991) pp. 179–181.*
Diamond, Arthur S. (ed.) Handbook of Imaging Materials. New York: Marcel–Dekker, Inc. (1991) pp. 222–224.*

* cited by examiner

*Primary Examiner*—Christopher Rodee
(74) *Attorney, Agent, or Firm*—Oliff & Berridge, PLC

(57) ABSTRACT

The toner comprises a white color toner particle and an external additive containing a hydrophobic titanium oxide particle. The absolute charge value of the toner is 20 to 50 $\mu$C/g. The developer contains a white color toner particle and a carrier having a surface coated with a resin containing a fluororesin.

14 Claims, No Drawings

TONER FOR DEVELOPING AN ELECTROSTATIC LATENT IMAGE, DEVELOPER, DEVELOPER UNIT, AND METHOD FOR FORMING AN IMAGE

BACKGROUND OF THE INVENTION

1. Field of the Invention

The present invention relates to a toner for developing an electrostatic latent image, a developer for developing an electrostatic latent image, a developer unit, and a method for forming an image, which are used in printing using an electrophotography, an electrostatic recording method and the like.

2. Description of the Related Art

Electrophotography, which is a method for visualizing image information by forming an electrostatic latent image, is currently employed in various fields. This method is already well known in the art as described in, for instance, U.S. Pat. Nos. 2,297,691, 2,357,809 and the like. In general, electrophotography comprises the steps of forming an electrostatic latent image on a photoreceptor by charging and exposing, forming a toner image by developing the electrostatic latent image using a developer containing a toner, transferring the toner image onto a transfer material such as paper or a sheet, and fixing the toner image on the transfer material by utilizing heat, a solvent, pressure and the like to obtain a permanent image.

Recently, electrophotography at present employ a so-called full-color machine in which black toner is used in addition to the magenta, cyan, and yellow toners. Electrophotography is presently used not only in printers or copiers, but also in a wider application field. In particular, electrophotography is required to be used in a field, which is close to a printing machine, a duplicator and the like. However, so-called full-color machines are generally intended for use in office. Accordingly, such full-color machines are not always applicable to all types of printing field. For instance, such machines cannot be used for all possible printed articles ranging from those paper recording media, such as advertisement leafs, books, magazines, etc., to display plate recording media other than paper, such as electric appliances and automobile bodies. Further, although printing in the field of a duplicator or the like is made using special colors, and there is a strong demand for white color and highly dense red colors, it is difficult for a general full-color machine to form those colors. Moreover, in general, a full-color machine such as full-color printers and full-color copiers cannot satisfy the demand for colors with high image density and high shielding properties.

The demand for high image density and high shielding properties may be satisfied by using a colorant corresponding to the special colors, and by increasing the concentration of the colorant. For instance, a white-colored colorant represented by titanium oxide is generally used for the white toner. However, the toner colorant must be added at a considerably larger amount to achieve the desired high image density and shielding property. Titanium oxide added in a large quantity brings about unfavorable results such as a drop in charge ability, adhesion of the colorants to the carriers and generation of fogging due to an increase in the electric conductivity of the toner. The same tendency occurs with red color toner or with a black color toner.

As the development method of the developer, there are, for instance, a jumping brush development method in which development is carried out while applying a bias electric field between a developer holding member and a photoreceptor, a cascade development method as described in U.S. Pat. No. 2,618,552, a magnetic brush method as described in U.S. Pat. No. 2,874,063, and a touch down method as described in U.S. Pat. No. 2,895,847 and the like. The magnetic brush method is a representative method using a so-called two-component developer prepared by mixing a carrier and a toner. This method uses magnetic particles, such as those of steel and ferrite, as the carriers, and the developer comprising the toner and the magnetic carrier is carried on a magnet, and the developer is formed into a brush-like manner by applying a magnetic field with the magnet. Then, by bringing the magnetic brush into contact with the electrostatic latent image provided on the photoreceptor, the toner inside the brush is attracted to the latent image depending on the quantity of charge to implement the development. The carriers for use in this method can be roughly divided into two types: coated carriers having a coating film on the surface thereof, and non-coated carriers having no coating film on the surface thereof. Many types of coated carriers are developed and brought into practice because the coated carriers are superior with respect to the life of the developer and the like. The coated carriers should at least be capable of providing proper charge ability (charge value and distribution of charge) to the toner, maintaining the proper charge ability for a long duration of time, etc. Accordingly, various types of coated carriers having excellent resistances against impact and friction, which do not change the charge ability of the toner, and which yet remain stable under environmental changes such as those of moisture, temperature , etc has been proposed For instance, Japanese Patent Application Laid-Open Nos. 61-80161, 61-80162, and 61-80163 disclose preparing a coated carrier having a relatively long life, wherein the coated carrier is prepared by coating the surface of a carrier core material with a copolymer of a nitrogen-containing fluorinated alkyl (meth) acrylate and a vinyl monomer, or a copolymer of a fluorinated alkyl (meth) acrylate and a nitrogen-containing vinyl monomer. Further, Japanese Patent Application Laid-Open Nos. 1-18150 and 2-79862 disclose a coated carrier having a relatively hard coated film, which are each prepared by coating the surface of a carrier core material with a polyamide resin and a melamine resin, respectively, followed by hardening, However, these carriers have problems in that they cannot sufficiently prevent contamination (impaction) of the carrier surface attributed to the toner components. The contamination of carrier caused by an adhesion of components of a toner to carrier or the like is unpreferable.

In order to prevent impaction from occurring, it has been proposed to form a coated film of a resin having small surface energies on the surface of carriers, for instance, the silicone resin is disclosed in Japanese Patent Application Laid-open No. 60-186844, or the fluororesin disclosed in Japanese Patent Application Laid-Open No. 64-13560. However, in the carriers above, the silicone resin or the fluororesin certainly exists relatively in a large amount in the vicinity of the carrier surface, but thickness of the coated film is small. Accordingly , the effect of the resin on these carriers is gradually lost, and, inversely, the problem of the impaction is caused after prolonged use due to wear of the coated film, which is gradually caused. Furthermore, in case of performing copying continuously using the developer as described above, it is certainly possible to produce an initial image with excellent reproducibility in image density and image quality. However, after producing several ten thousands of copies, the image density decreases to reproduce an image of poor gradation and granularity. In particular, when toner wherein the concentration of colorants is increased is used to obtain high image density, especially in the case of white toners using titanium oxide in a large amount is used, image degradation occurs due to impaction occurring on the carrier surface.

On the other hand, in order to match processes within the copier, the toner used therein should be superior in flow ability, resistance against caking, fixing ability, charge ability, ability to be cleaned and the like. Accordingly, it has recently been proposed to add a highly value-added additive capable of imparting favorable flow ability, resistance against caking, maintainability of charge, environmental stability and the like as an external additive. For instance, it has been proposed to add an inorganic oxide, such as silica, titanium oxide on the surface of the toner.

Silica exhibits excellent properties such as resistance against caking and the ability to impart flow ability to the toner. However, due to its strong negative charge characteristics intrinsic to the silica itself, it tends to provide a charging ability depending on the environmental conditions. Accordingly, various proposals have been made to apply a hydrophobic treatment to the surface of silica (see, for instance, Japanese Patent Application Laid-Open Nos. 46-5782, 48-47345, 48-47346, 64-73354 and 1-237561 etc.). However, the environmental dependence of charging ability of silica has not been sufficiently improved up to the present without negatively influencing other characteristics such as the resistance against caking and flow ability of silica.

When titanium oxide is added to the toner surface from exterior, the charge level can be lowered. Further, when titanium oxide is applied a hydrophobic treatment with applying a hydrophobic treatment agent and added to a toner from exterior, the charge level and the environmental dependence of the toner can be more easily controlled. However, on the other hand, it suffers problems concerning aggregation of titanium oxide and the like after performing the hydrophobic treatment. Accordingly, since the amount to be subjected to the hydrophobic treatment becomes limited, the charge level cannot be decreased over a certain value. Titanium oxide described above can be produced, in general, by refining and calcining $TiO(OH)_2$ obtained by sulfuric acid method (wet method) with ilmenite ores. Titanium oxide obtained in accordance with the process above certainly contains aggregated particles that are generated as a result of dehydration condensation. Re-dispersion of such aggregated particles is, however, not easy by using a prior art technology. When a crystalline titanium oxide (i.e., rutile having a specific gravity of 4.2 or anatase having a specific gravity of 3.9) is prepared into fine powder, secondary aggregation or tertiary aggregation is found to occur in the powder. This considerably impairs the effect of improving flow ability of the toner as compared with that of silica. Concerning the recent market demand for high quality images, in particular, the trend is for decreasing diameter size of toner particles. However, toner particles with smaller diameter increase the adhesion strength among the particles as to impair the flow ability of the toner. Hence, when toner particles with smaller diameter are used, the flow ability-imparting ability of titanium oxide further tends to become inferior.

In light of such circumstances, it has been proposed to add hydrophobic titanium oxide conjointly with hydrophobic silica to the toner, both of which being obtained by applying thereto surface treatment, with an aim,to achieve both improvements in flow ability and in the environmental dependence of charging (see Japanese Patent Application Laid-Open No. 60-136755, etc.). However, due to stress applied by stirring, the effect of only one of the two tends to be exhibited more distinctly. Hence, it is difficult to mutually compensate for the disadvantages over a long period of time. For instance, the hydrophobic titanium oxide improves the charge characteristics and the flow ability of the toner at the initial stage. However, the collision of the toner with the carrier caused by stirring, or the friction between the toner and the blade or the sleeve causes a coupling agent to peel off from the surface of the titanium oxide as to greatly change the charge characteristics of the toner. The reason for this is that, presumably, in case of the hydrophobic titanium oxide described above, the reactivity of core surface of the titanium oxide with respect to the coupling agent is very weak, and that thereby the bonding with the coupling agent becomes extremely weak as compared with the case of silica. Furthermore a due to the embedding of the additives into the surface of the toner, there occurs another problem in that the flow ability of the powder is impaired, and that contamination (Spent) by these additives is generated on the surface of the carriers On the other hand, it has been proposed to add a hydrophobic amorphous titanium oxide to the toner from exterior (see Japanese Patent Application Laid-Open Nos. 5-204183 and 5-72797, etc.). In this case, however, because the adhesion force of the amorphous titanium oxide with respect to the photoreceptor is too strong, there are problems such as flaws on the photoreceptor on cleaning and white spots on images.

SUMMARY OF THE INVENTION

The present invention aims to solve the problems in the prior art described above and to achieve the object below. More specifically, an object of the present invention is to provide a toner for developing an electrostatic latent image, a developer for an electrostatic charge image, a developer unit, and a method for forming images, that provide images of high image density and high shielding property and with which it becomes difficult for image defects to arise.

The problems described above are solved by following means. That is, a first aspect of the present invention is a toner for developing an electrostatic latent image which comprises a white color toner particle and an external additive. The white color toner particle contains at least a binder resin having a volume average particle diameter of no greater than 14 $\mu$m and a colorant having a concentration of 20 to 50% by weight with respect to the binder resin. The external additive contains a hydrophobic titanium oxide particle having a BET specific surface area of 40 to 250 $m^2/g$. The absolute charge value of the toner is 20 to 50 $\mu C/g$.

A second aspect of the present invention is a developer for developing an electrostatic latent image. The developer comprises a toner for developing an electrostatic latent image and a carrier. The toner comprises a white color toner particle containing at least a binder resin and a colorant, with the particles having a volume average particle diameter of no greater than 14 $\mu$m and a concentration of the colorant being 20 to 50% by weight with respect to the binder resin. A surface of the carrier is coated with a resin containing a fluororesin.

In accordance with the present invention, the colorant described above is preferably titanium oxide.

The hydrophobic titanium oxide particle is preferably obtained by a reaction of $TiO(OH)_2$ with a silane compound.

The specific gravity of the hydrophobic titanium oxide particle is preferably 2.8 to 3.8.

Preferably, the absolute charge value for the developer is 20 to 50 $\mu$C/g.

The electric resistance of the core material of the carrier is preferably $1\times10^{7.5}$ to $1\times10^{9.5}\Omega$.

Preferably, the resin coating the carrier surface contains at least one of resin particles and electrically conductive particles dispersed therein.

DESCRIPTION OF THE PREFERRED EMBODIMENTS

The toner for developing an electrostatic latent image according to the present invention comprises at least a binder resin and a colorant. The volume average particle diameter of the toner is 14 $\mu$m or less, and the toner comprises a white color toner particle containing the colorant at a concentration of 20 to 50% by weight with respect to the binder resin, and an additive containing a hydrophobic titanium oxide particle having a BET specific surface area of 40 to 250 $m^2$/g. The additive is added to the surface of the white color toner particle from exterior. The absolute charge of the toner is 20 to 50 $\mu$C/g. Because the toner comprises the white color toner particle. and the hydrophobic titanium oxide particle as an additive, and the absolute charge value of the toner is 20 to 50 $\mu$C/g, flow ability of the toner particles, environmental dependence of charge, and resistance against carrier contamination can be improved even if the colorant is incorporated at a relatively high concentration. Accordingly, the toner has high image density and high shielding property and it becomes difficult for image defects to arise.

The white color toner particle comprises at least a binder resin and a colorant, and a pigment is favorably used as the colorant, Examples of the pigment include titanium oxide, zinc white, antimony white, zinc sulfide, silicon oxide and the equivalent. However, from the viewpoint of achieving both charge abilities and shielding property, titanium oxide is preferable. The titanium oxide can be obtained by a method using sulfuric acid, chlorine or the like, and any of an anatase, rutile, brookite crystalline structure or the like can be used.

The concentration of the colorant is 20 to 50% by weight, but more preferably is 30 to 45% by weight. If the concentration of the colorant is less than 20% by weight, there are drawbacks in that a sufficient image density can not be obtained and the shielding property is lowered, thereby the color of the base material (paper, OHP sheet, other recording media, etc.) is visible. When concentration of the colorant exceeds 50% by weight, there are drawbacks in that electric conductivity drops and the colorants adheres to the carrier.

Examples of the binder resin include homopolymers and copolymers of: monoolefins such as ethylene, propylene, butylene and isoprene; vinyl esters such as vinyl acetate, vinyl propionate, vinyl benzoate and vinyl lactate; esters of $\alpha$-methylene aliphatic acid group monocarboxylic acids, such as methyl acrylate, phenyl acrylate, octyl acrylate, methyl methacrylate, ethyl methacrylate, butyl methacrylate and dodecyl methacrylate; vinyl ethers such as vinyl methyl ether, vinyl ethyl ether, vinyl butyl ether; and vinyl ketones such as vinyl methyl ketone, vinyl hexyl ketone and vinyl isopropenyl ketone. Examples of particularly representative binder resins include polystyrenes, styrene-alkyl acrylic copolymers, styrene-butadiene copolymers, styrene-maleic anhydride copolymers, polystyrenes, polypropylenes, etc. Examples also include polyesters, polyurethanes, epoxy resins, silicone resins, polyamides and modified rosins.

The white toner particle has a volume average particle diameter of 14 $\mu$m or less, preferably 5 to 12 $\mu$m, and more preferably 6 to 10 $\mu$m. When the volume average particle diameter exceeds 14 $\mu$m, favorable charge abilities (amount and the distribution of charge) and appropriate charge abilities cannot be maintained over a long period of time, and the effect of improving dot reproducibility, gradation, and granularity becomes poor. When the volume average particle diameter is less than 5 $\mu$m, not only is the flow ability of the toner reduced but also the charging ability is not imparted from the carrier, whereby background fogging is sometimes generated and density reproducibility is sometimes reduced.

As a particle size (diameter) distribution of white toner particles, it is preferable that, in total white toner particles. white toner particles having 4 $\mu$m or less particle diameter are comprised in quantities of 6 to 25% by number, and more preferably 6 to 16% by number of the total number of white color toner particles. When the number of toner particles having a particle size diameter of 4 $\mu$m or less is less than 6%. the number of particles which contribute to dot reproducibility and granularity is too small. Further these particles of this size are selectively consumed because they have an effective particle diameter for forming an image. Therefore, it is difficult to remain them inside the developer, and ratio of white toner particles which do not contribute to those abilities increases inside the developing machine when copying is carried out repeatedly, and whereby image quality gradually deteriorates. When the number of white toner particle exceeds 25%, the toner flow ability is reduced, and there is the potential for transportability of the developer to drop, thereby developing ability is lowered.

It is preferable that, in total white toner particles, the white toner particles having a particle size diameter of 16 $\mu$m or larger are comprised in quantities of 1.0% by volume or less. When particles having a particle diameter of 16 $\mu$m or larger exceed 1.0% by volume, there is not only a negative impact on fine line reproducibility and gradation, but also coarse powder toner particles having a particle diameter size of 16 $\mu$m or larger are incorporated into the toner layer during transfer and prevent static adhesion between the transfer body and the photoreceptor. Hence, this may reduce transfer efficiency and consequently reduce image quality.

By using white color toner particle having the particle size distribution described above, faithful reproduction of fine latent image dots can be expected even when originals having a large image area and gradation of image density, such as photographs, art graphics. pamphlets, etc are repeatedly copied.

White color toner particle can further contain, if necessary, a charge control agent, an offset prevent agent, or any other known components. In this case, colorless or pale color components that do not affect the color tone are preferable. Known charge control agents may be used as the charge control agent, but an azo-based metal complex, or a metal complex or a metal salt of salicylic acid or an alkylsalicylic acid are preferable. Examples of the offset prevent agent include low molecular weight propylenes, low molecular weight polyethylenes, waxes and the like.

The toner of the present invention comprises a hydrophobic titanium oxide particle having a BET specific surface area of from 40 to 250 $m^2$/g, as an additive to be added the toner from exterior. However, the BET specific surface area of the hydrophobic titanium oxide particle is preferably 80 to 200 $m^2$/g. While hydrophobic titanium oxide particle having a BET specific surface area greater than 250 $m^2$/g improves flow ability, it becomes difficult to control their adhesion to the toner particles and they tend to become buried in the surface of the white toner particle, whereby the quality of the particles is lowered and charge properties drop. Furthermore, when the specific surface area is less than 40 $m^2/g$, not only is the ability to impart flow ability insufficient, but also filming and scratches on the surface of the photoreceptor (latent image carrier) are generated.

Examples of the hydrophobic titanium oxide particle include those obtained by subjecting particles of titanium acid oxide, such as $TiO_2$ and $K_2O\cdot(TiO_2)_n$ to a hydrophobic treatment. Additives other than the hydrophobic titanium oxide particle and which are added from exterior also can be used. Examples thereof include inorganic oxide particles such as those of $SiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO\cdot SiO_2$, $Al_2O_3\cdot 2SiO_2$, $CaCO_3$, $MgCO_3$, $BaSO_4$ and $MgSO_4$.

The hydrophobic treatment can be carried out by, for example, immersing the inorganic oxide in a hydrophobic treatment agent.

There are no limitation on the hydrophobic treatment agent used. Examples thereof include silane coupling agents, silicone oils, titanate coupling agents and aluminum-based coupling agents. These may be used either alone or may be used in combination of two or more. Among them, silane coupling agents are preferable. It is also possible to use a chlorosilane, an alkoxylsilane, a silazane, special silylating agent and the like as the silane coupling agent. Specific examples include methyltrichlorosilane, dimethyldichlorosilane, trimethylchlorosilane, phenyltrichlorosilane, diphenyldichlorosilane, tetramethoxysilane, methylmethoxysilane, dimethyldimethoxysilane, phenyltrimethoxysilane, diphenyldimethoxysilane, tetraethoxysilane, methyltriethoxysilane. dimethyldiethoxylsilane, phenyltriethoxylsilane, diphenyldiethoxysilane, isobutyltriethoxysilane, decyltrimethoxysilane, bexamethyldisilazane, N,O-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxylcyclohexyl)ethyltrimethoxysilane, γ-glycidoxypropyltrimethoxysilane, γ-glycidoxypropylmethyldiethoxysilane, γ-mercaptpropyltrimethoxysilane, γ-chloropropyltrimethoxysilane, etc.

The amount of the hydrophobic treatment agent depends on the type of fine inorganic oxide particles and cannot be prescribed unconditionally. However, in general, 5 to 50 parts by weight with respect to 100 parts by weight of the inorganic oxide particles is appropriate.

The specific gravity of the hydrophobic titanium oxide particle is preferably 2.8 to 3.8, and more preferably 3.0 to 3.6. When the specific gravity of the hydrophobic titanium oxide particle is within this range, which is smaller in value in comparison with the specific gravity of conventional titanium oxide, improvements in environmental dependence of charging and in flow ability similar to those achieved by conventional titanium oxide can be achieved with a smaller amount. Thus, there is advantage that various other properties can be achieved concomitantly without impairing the transparency of the color toner.

When the specific gravity of the hydrophobic titanium oxide particle is less than 2.8, the hydrophobic treatment agent (e.g., silane compound) must be added in excess, and this causes the hydrophobic treatment agents to partially react with each other, whereby aggregates are easily formed and the desired flow ability can not be obtained. When the specific gravity of the hydrophobic titanium oxide particles exceeds 3.8, it is difficult for the particles to be dispersed on the toner surface at the time of blending. Even if the particles are uniformly dispersed, hydrophobic titanium oxide particles at protrusions in the toner move to concavities due to the stress in the process of development, whereby the desired flow ability and charge ability are reduced. Alternatively, the hydrophobic titanium oxide particles at protrusions in the toner tend to be released from the toner, and in the two-component developer, the free hydrophobic titanium oxide particles transfer to the surface of the carrier, whereby the volume intrinsic resistance of the carrier is greatly altered, whereby may result in the failure to obtain excellent quality that is stable over a long period of time.

Hydrophobic titanium oxide particle obtained by reacting $TiO(OH)_2$ with a silane compound is preferable in comparison with hydrophobic titanium oxide particle that has been calcinated and hydrophobicized, because a larger amount of the silane compound can be used and specific gravity of the particles become smaller. Furthermore, by reacting $TiO(OH)_2$ with a silane compound, the silane compound can be reacted when the $TiO(OH)_2$ is hydrolyzed. As a result, titanium oxide produced from $TiO(OH)_2$ and which is not in a state of an aggregation but in a state of primary particles can be treated with the silane compound, and hydrophobic titanium oxide particle in the primary particle state free from aggregation can be obtained. Thus, there is the advantage in that it becomes possible to provide toner particles having excellent flow ability and resistance against caking, and that provide excellent color images with superior transparency that is required of color toners.

The hydrophobic titanium oxide particle obtained by reacting $TiO(OH)_2$ with a silane compound can be prepared, for instance, as follows.

First, $TiO(OH)_2$ is prepared by a sulfuric acid method (wet method) using ilmenite ores as shown below.

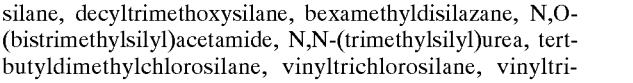

$$FeTiO_2+2H_2SO_4 \rightarrow FeSO_4+TiOSO_4+2H_2O$$

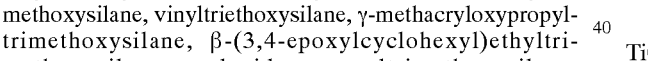

$$TiOSO_4+2H_2O \rightarrow TiO(OH)_2+H_2SO_4$$

Then, the silane compound is added to the prepared $TiO(OH)_2$, and more preferably to a water dispersion of $TiO(OH)_2$. After hydrophobicizing a part or the entire OH groups in $TiO(OH)_2$, the reaction product is filtered, rinsed, dried, and ground.

There are no particular limitations on the silane compounds. The silane compounds enumerated above i.e., silane coupling agents, silicone oils, titanate-based coupling agents, aluminum-based coupling agents and the like can be used. Among these, the silane coupling agents are preferable.

Generally, the amount of the silane compound used is preferably about 2 to 50 parts by weight, more preferably 3 to 35 parts by weight, and most preferably 5 to 20 parts by weight, with respect to 100 parts by weight of $TiO(OH)_2$. In the reaction above, the specific gravity, the negative charge ability and the like of the hydrophobic titanium oxide particle can be finely adjusted by properly selecting the type, processing amount and the like of the silane compound. That is, by increasing the quantity of the silane compound, hydrophobic titanium oxide particle with a small specific gravity and a high ability to impart charge can be obtained, and by decreasing the quantity of the silane compound, hydrophobic titanium oxide particle with a large specific gravity and a low ability of imparting charge can be obtained.

The absolute charge value of the toner for developing electrostatic latent image of the present invention is 20 to 50

μC/g, preferably 25 to 45 μC/g, and more preferably 27 to 40 μ/g. When the absolute charge is less than 20 μC/g. there occurs fogging in the background, whitening of the image. scattering of carriers and the like. When the absolute charge value exceeds 50 μC/g, image density decreases due to insufficient development. The charge can be properly adjusted by increasing or decreasing the amount of a hydrophobic titanium oxide particle or by adding a charge control agent in the toner, etc.

As described above, the toner of the present invention can be properly prepared in accordance with known methods without any particular limitations as long as the toner has the constitution described above.

(Developer for Developing an Electrostatic Latent Image)

The developer for developing an electrostatic latent image of the present invention comprises a toner for developing electrostatic latent image and a carrier. The toner contains at least white color toner particle containing at least a binder resin and a colorant, with the particles having a volume average particle diameter of 14 μm or smaller and the concentration of the colorant being 20 to 50% by weight with respect to the binder resin. The carrier has a surface coated with a resin containing a fluororesin. Since the surface of the carrier is coated with a resin including a fluororesin and has low surface energy, it can prevent impaction, even with respect to the aforementioned toner comprising the white toner particle containing the colorant at a relatively high concentration. Accordingly, the developer has high shielding property and it is difficult for image defects to occur.

The toner used in the developer is the same toner of the present invention, with the exception that it has the constitution described above. Preferred embodiments of the toner are the same as those described above.

The carrier comprises a core material having surface that is coated with a resin containing a fluororesin. The core material has an electric resistance of preferably $1\times10^{7.5}$ to $1\times10^{9.5}\Omega$, and more preferably, from $1\times10^{8}$ to $1\times10^{9}\Omega$. When the electric resistance is lower than $1\times10^{7.5}\Omega$, there is the potential for a charge to be injected into the carrier and for the carrier itself to undergo development when the concentration of the toner in the developer decreases due to repeated copying. When the electric resistance is higher than $1\times10^{9.5}\Omega$, there is the potential for image quality to be adversely affected such as a distinct edge effect or pseudo bordering of an image (a pseudo outline is formed on a boundary of an image).

Any core material can be used without particular restriction so long as it satisfies the conditions above. Examples include magnetic metals such as iron, steel, nickel and cobalt; alloys of the magnetic metals with manganese, chromium and rare earth metals; and magnetic oxides such as ferrite and magnetite. Among these, ferrite is preferable in view of surface properties of the core material and core material resistance, and alloys of ferrite with manganese, lithium, strontium and magnesium are particularly preferable.

The electric resistance of the core material can be measured by using, for example, a SM8210 super mega-ohm meter (manufactured by TOA Denpa Kogyo, Co., Ltd.), at a temperature of 25±2° C. and 60±5% RH, by the following procedure.

First, a 200-mg sample is precisely weighed with an electronic balance, and seasoning is conducted for no less than 1 hour under the measuring environment condition. After the power switch of the mega-ohm meter has been switched on for no less than 30 minutes, the meter is calibrated and preparation for measurement are concluded. Then, the sample is interposed between measuring electrodes separated by at a distance of 6.5 mm, and a magnet having a magnetic force of 1,500 Gauss is disposed to the left and the right side of the electrodes. The magnets are moved 5 times after the magnets are disposed, to ensure that the sample is equivalent from each electrode. After verifying that the voltage of the mega-ohm meter is indicates 1,000 V and that the range indicates CAL, the electrodes are connected to measuring terminals. The charge-discharge switch is set to the discharge, and after charging for 5 seconds, the switch is set to MEASURE. The range is selected so that the indicator points from CAL to show an appropriate scale. The value 10 seconds after setting the switch to MEASURE is read, and the normal logarithm (log) value of the observed value is taken to obtain the resistance of the sample.

The fluororesin included in at least the coating resin can be properly selected depending on the object. Examples thereof include known fluororesins such as polytetrafluoroethylene, polyvinyl fluoride, polyvinylidene fluoride and polychlorotrifluoroethylene. These fluororesins may be used alone, or two or more types may be used conjointly.

The film that is provided by coating the resin on the carrier core preferably contains at least resin particles and/or electrically conductive particles dispersed therein. when resin particles are dispersed in the film, they are uniformly dispersed in the thickness direction and in the direction tangential to the carrier surface. Hence, even if the film is worn down by prolonged use of the carrier, the condition of the surface of the carrier can be maintained as in the original state. Accordingly, a favorable ability to impart charge to the toner can be retained over a long period of time. Similarly, when electrically conductive particles are dispersed in the coating film, they are uniformly dispersed in the thickness direction and in the direction tangential to the carrier surface. Thus, even if the film is worn down by prolonged use of the carrier, a surface condition of the carrier as in the original state can be maintained. Accordingly, carrier degradation can be prevented from occurring for a long time. Furthermore, when the resin particles and the electrically conductive particles are dispersed in the film, the above effects can be achieved at the same time.

Examples of the resin particles include thermoplastic resin particles and thermosetting resin particles. Thermosetting resin particles are preferable in that it is easy to increase hardness. From the viewpoint of imparting negative charge to the toner, resin particles that comprise a resin containing nitrogen atoms are preferable. One type of resin particles may be used, or two or more types of resin particles may be used. The resin particles preferably have an average particle diameter of, for instance, 0.1 to 2 μm, and more preferably 0.2 to 1 μm. When average particle diameter of the resin particles is less than 0.1 μm, the dispersion of the resin particles within the film becomes extremely poor. When average particle diameter of the resin particles exceed 2 μm, it become easy for the resin particles to fall off from the film and the originally intended effect may not be exhibited.

Examples of the electrically conductive particles include metallic particles such as those of gold, silver and copper; particles of carbon black; particles of semiconductive oxides, such as those of titanium oxide and zinc oxide; and particles of titanium oxide, zinc oxide, barium sulfate, aluminum borate and potassium titanate, whose surface is covered with tin oxide, carbon black, metals or the like. These can be used alone, or two or more of them can be used conjointly. Carbon black particles are preferable in view of production stability, cost and conductivity. There are no particular limitations on the type of carbon black, but carbon black having a DBP oil absorption of about 50 to 250 ml/100 g is preferable in view of excellent production stability.

Examples of methods for coating the surface of the core material (carrier core material) with the coating resin include: immersing the core material in a liquid for forming the coating film including the resin; spraying the liquid for forming the coating film onto the surface of the core material; mixing the core material with the liquid for forming the coating film in a state in which the core material is floated by flowing air, followed by removing the solvent (kneader-coater method). In the present invention, the kneader-coater method is preferable.

There are no particular limitations on the solvent used in the liquid for forming the coating film, as long as it is possible to dissolve only the coating resin. The solvent can be selected from known solvents. Examples include aromatic hydrocarbons such as toluene and xylene; ketones such as acetone and methyl ethyl ketone; or ethers such as tetrahydrofuran and dioxane.

The absolute charge value of the developer for developing electrostatic latent image of the present invention is preferably 20 to 50 $\mu$C/g, more preferably 25 to 45 $\mu$C/g, and most preferably 27 to 40 $\mu$C/g. When the absolute charge value is less than 20 $\mu$C/g, there occurs a fogging in the background, whitening of the image and a scattering of the carrier. When the absolute charge exceeds 50 $\mu$C/g, there may be a drop in image density due to insufficient development. The charge can be properly controlled by, for instance, the coverage of resin on the carrier, the amount of fine crosslinked melamine resin particles, the content of fluorine in the coated resin and the like.

The developer of the present invention can be prepared by mixing the carrier and the toner specified above, but there are no particular limitations on the method of preparation. The developer can be obtained in accordance with a known method.

(Developer Unit)

The developer unit for electrostatic latent image of the present invention comprises a plurality of developers for developing electrostatic latent images, and forms a multicolored image. At least one of the developers is a developer containing the toner for forming electrostatic latent image according to the first aspect of the present invention as described above, or the developer according to the second aspect of the present invention as described above. Further, at least one of the developers is a developer containing a toner for developing electrostatic latent image which contains black color toner particles having a colorant concentration of 4 to 15 w. The developer unit of the present invention comprises, as the developer for forming a white toner image, the developer containing the excellent toner for developing an electrostatic latent image of the present invention or the excellent developer of the present invention as described above. thus, even when the developer containing the black toner particle which comprises the colorant at a specific concentration is used to form a black color toner image as a background and a white color toner image is formed after a formation of the black color toner image, for instance, it is possible to obtain an excellent image of high image density, high shielding properties, and in which it is difficult for image defects to arise.

In the developer unit of the present invention, carbon black is preferable as the colorant to be incorporated in the black color toner particles. Examples of other colorants include a magnetic powder. However, when magnetic powder is used in a two-component development method, developer resistance may drop and cause white spots in an image portion due to the scattering of the carriers and the like.

The concentration of the colorant is 4 to 15%, preferably 5 to 12%, and most preferably 6 to 10%. When the concentration of the colorant is less than 4%, a favorable image density formed from the black toner and the shielding properties cannot be obtained, and drawback sometimes arises in that the base color under the black image is not hidden. When the concentration exceeds 15%, charging ability may drop, the colorant may adhere to the carrier, and developer resistance may drop, whereby the carrier itself may be developed, and causes image defects (due to scattering of the carrier) such as white spots.

The developer unit according to the present invention comprises a plurality of developers for developing an electrostatic latent image. In general, the unit is constructed from developing apparatuses that respectively include the developer for each color. There are no particular limitations on the developing apparatus. Known developing apparatuses that develop by contacting or not contacting the developer with a brush, a roller or the like can be used. Further, any number of a photoreceptor, developer holding member and the like can be utilized in the unit of the present invention.

(Method for Forming Images)

The method for forming images according to the present invention is a method for forming a multicolored image by using a plurality of developers. The method comprises the steps of: charging an electrostatic latent image holding member (photoreceptor) surface; forming an electrostatic latent image by exposing the holding member surface; forming a white toner image by developing the electrostatic latent image using the developer for developing an electrostatic latent image containing the toner as described in the first aspect of the present invention or the developer as described in the second aspect of the present invention; transferring the white color toner image onto a transfer body; forming a black toner image by developing the electrostatic latent image using an developer containing black color toner particles having a colorant concentration of from 4 to 15%; and transferring the black color toner image onto a transfer body. In the steps above, the steps related to the white color toner and the steps related to the black color toner may be reversed in order. Further, the times of these steps are not limited, and one transfer body is utilized in the steps. Further, one or more photoreceptors can be used.

The method for forming images according to the present invention utilizes, as the developer for forming the white color toner image, the developer containing the toner of the present invention or the developer of the present invention. Accordingly, when an electrostatic image developer containing the colorant at a specified concentration is used as the developer for forming black color toner images and a white color toner image is formed on the black images after forming the black color toner image on the background, an image with high image density and high shielding properties, and in which it is difficult for image defects to arise, can be obtained.

There are no particular limitations on the steps in the method, and the steps can be performed in a manner similar to those conventionally used. The black color toner as described in the developer unit can be used.

EXAMPLES

The present invention will now be described in further detail by way of examples. However, these examples do not limit the present invention. The term "parts" as referred to hereinafter signifies "parts by weight" unless otherwise stated.

Preparation of Toner Particles A

Polyester resin 100 parts (a linear polyester obtained by condensation polymerization of terephthalic acid/bisphenol A ethylene oxide adduct/cyclohexane dimethanol)

Titanium oxide (CR60: prepared by Ishihara Sangyo Co. , Ltd.) 35 parts

The components above are sufficiently pre-mixed in a Henschel mixer, and are further melted and kneaded in a two-axes roll mill. After cooling, the resulting product is finely size-reduced by using a jet mill, and is classified twice by using an air classifier. Thus are obtained white color toner particles A having an average volume particle size of 8.0 $\mu$m and a colorant concentration of 35% by weight.

Preparation of Toner Particles B

White color toner particles B having an average volume particle size of 8.0 $\mu$m and a colorant concentration of 15% by weight are prepared in the same manner as toner particles A, except that the amount of titanium oxide is changed to 15 parts.

Preparation of Toner Particles C

White color toner particles C having an average volume particle size of 8.0 $\mu$m and a colorant concentration of 60% by weight of is prepared in the same manner as toner particles A, except that the amount of titanium oxide is changed to 60 parts.

Preparation of Toner Particles D

Black color toner particles D having an average volume particle size of 8.0 $\mu$m and colorant concentration of 8% by weight is prepared in the same manner as toner particles A, except that titanium oxide is changed to 8 parts of carbon black.

Preparation of Toner Particle E

Black color toner particles E having an average volume particle size of 8.0 $\mu$m and colorant concentration of 2% by weight is prepared in the same manner as toner particles A, except that titanium oxide is changed to 2 parts of carbon black.

Preparation of Toner Particles F

Black color toner particles F having an average volume particle size of 8.0 $\mu$m and colorant concentration containing 20% by weight is prepared in the same manner as toner particles A, except that titanium oxide is changed to 20 parts of carbon black.

Preparation of Hydrophobic Titanium Oxide Particle A

Ilmenite ores is dissolved in sulfuric acid to separate iron powder, and $TiO(OH)_2$ is produced by using a wet precipitation process for hydrolyzing $TiOSO_4$. In the process of producing $TiO(OH)_2$, dispersion control and rinsing are performed for hydrolysis and nucleation.

Then, 100 parts of the obtained $TiO(OH)_2$ are dispersed in 1000 ml of water, and 20 parts of isobutyl trimethoxysilane are added dropwise at room temperature while stirring. The resulting product is filtered, and rinsed repeatedly. The obtained titanium oxide with a surface rendered hydrophobic with isobutyl trimethoxysilane is dried at 150° C. to obtain hydrophobic titanium oxide particles A having a BET specific surface area of 120 $m^2/g$ and a specific gravity of 3.4.

Preparation of Hydrophobic Titanium Oxide Particle C

Hydrophobic titanium oxide particles B having a BET specific surface area of 100 $m^2/g$ and a specific gravity of 3.5 are prepared in the same manner as the hydrophobic titanium oxide particles A, except that the amount of isobutyl trimethoxysilane is changed to 10 parts.

Preparation of Hydrophobic Titanium oxide Particle C

Hydrophobic titanium oxide particles C having a BET specific surface area of 32 $m^2/g$ and a specific gravity of 3.2 are prepared in the same manner as the hydrophobic titanium oxide particles A, except that the amount of isobutyl trimethoxysilane is changed to 30 parts and the particles is dried at 180° C.

Preparation of Hydrophobic Titanium Oxide Particle D

One hundred parts of the obtained $TiO(OH)_2$ is dispersed in 1000 ml of water, and 25 parts of methyl trimethoxysilane are added dropwise at room temperature while stirring. The resulting product is filtered, and rinsed repeatedly. The obtained titanium oxide with a surface rendered hydrophobic with methyl trimethoxysilane is dried at 180° C. to obtain hydrophobic titanium oxide particles D having a BET specific surface area of 280 $m^2/g$ and a specific gravity of 3.3.

Preparation of Hydrophobic Titanium Oxide Particle E

Rutile-type titanium oxide is dried with 10 parts of isobutyl trimethoxysilane to obtain hydrophobic titanium oxide particles E having a BET specific surface area of 110 $m^2/g$ and a specific gravity of 4.2.

Fine Hydrophobic Silicon Dioxide Particle F

"RX200" (manufactured by Nippon Aerosil Co., Ltd.; having a BET specific surface area of 140 $m^2/g$ and a specific gravity of 2.2) is used as fine hydrophobic silicon dioxide particles F.

Preparation of Carrier A

| | |
|---|---|
| Ferrite particles (Electric resistance: $1 \times 10^8$ Ω) | 100 parts |
| Toluene | 14 parts |
| Perfluorooctyl ethyl acrylate/methyl methacrylate copolymer (copolymerization ratio 40:60, Mw = 50,000 | 1.6 parts |
| Carbon black (VXC-72; manufactured by Cabott Inc.) | 0.12 parts |
| Crosslinked melamine resin (average particle size: 0.3 m $\mu$m) | 0.3 parts |

The components above, except for the ferrite particles, are dispersed by a stirrer for 10 minutes to prepare a solution for forming a coating film, and the solution for forming the coating film is placed in a vacuum evacuation kneader together with the ferrite particles. After stirring at 60° C. for 30 minutes. toluene is distilled off under reduced pressure to form a coating film on the surface of the ferrite particles. Thus is prepared carrier A.

Since carbon black particles and crosslinked melamine resin particles are diluted with toluene and dispersed previously by using a sand mill on the resin of the coating film. i.e., perfluorooctyl ethyl acrylate/methyl methacrylate copolymer, the coating film on the carrier contained uniformly dispersed carbon black and crosslinked melamine resin particles.

Preparation of Carrier B

Carrier B is prepared in the same manner as carrier A, except that silicone resin is used as the resin for the coating film in place of perfluorooctyl ethyl acrylate/methyl methacrylate copolymer.

The toner particles, additives (fine particles), and carriers thus prepared are listed below.

TABLE 1

| Toner particles | | | | |
|---|---|---|---|---|
| Toner particles (color) | Volume average particle size | (Number of toner particles 4 μm or smaller in size)/(Volume of toner particles 16 μm or greater in size) | Pigment Type | Pigment Concentration |
| A (white) | 8.0 μm | 10%/0.1% | Ti oxide: CR60 | 35 wt % |
| B (white) | 8.0 μm | 8%/0.1% | Ti oxide: CR60 | 15 wt % |
| C (white) | 8.0 μm | 9%/0.1% | Ti oxide: CR60 | 60 wt % |
| D (black) | 8.0 μm | 12%/0.4% | Carbon black: #25 | 8 wt % |
| E (black) | 8.0 μm | 10%/0.4% | Carbon black: #25 | 2 wt % |
| F (black) | 8.0 μm | 12%/0.4% | Carbon black: #25 | 20 wt % |

TABLE 2

| Additives (fine particles) | | | |
|---|---|---|---|
| Fine particles | Type | BET specific surface area | Specific gravity |
| A | Hydrophobic titanium oxide | 120 $m^2/g$ | 3.4 |
| B | Hydrophobic titanium oxide | 100 $m^2/g$ | 3.5 |
| C | Hydrophobic titanium oxide | 32 $m^2/g$ | 3.2 |
| D | Hydrophobic titanium oxide | 280 $m^2/g$ | 3.3 |
| E | Hydrophobic titanium oxide | 110 $m^2/g$ | 4.2 |
| F | Hydrophobic silicon dioxide | 140 $m^2/g$ | 2.2 |

TABLE 3

| Carriers | | | |
|---|---|---|---|
| | Coating film | | Electric resistance |
| Carrier | Resin type | Particles | of core material (Ω) |
| A | perfluorooctyl ethyl acrylate/ methyl methacrylate copolymer | Carbon black crosslinked melamine resin particles | $1 \times 10^8$ |
| B | silicone resin | Carbon black crosslinked melamine resin particles | $1 \times 10^8$ |

Examples 1 to 4 and Comparative Examples 1 to 4

In accordance with Table 4, white toners are each prepared by mixing 100 parts of the white color toner particle and 0.6 parts of each of the fine particles as additives by using a Henschel mixer. Then, in accordance with Table 4, 6 parts of each of the toners and 94 parts of the carrier are mixed to prepare a white color developer (developer which comprises the carrier and the white color toner)

TABLE 4

| Combination of toner (toner particles and additives) and carrier | | | |
|---|---|---|---|
| | White color developer White color toner | | |
| | Toner particles | Additive | Carrier |
| Example 1 | A | A | B |
| Example 2 | A | B | B |

TABLE 4-continued

| Combination of toner (toner particles and additives) and carrier | | | |
|---|---|---|---|
| | White color developer White color toner | | |
| | Toner particles | Additive | Carrier |
| Example 3 | A | F | A |
| Example 4 | A | F | B |
| Comp. Example 1 | B | A | B |
| Comp. Example 2 | C | A | B |
| Comp. Example 3 | A | C | B |
| Comp. Example 4 | A | D | B |

(Evaluation)

The white color toners or the white color developers thus prepared are evaluated as follows. A copy test is carried out by placing the obtained developers in the developer unit and using an electronic photocopier ("Color DocuTech60" manufactured by Fuji Xerox Inc.). The results are given in Table 5.

Evaluation of Shielding Properties

A copy test is performed in such a manner that sample image wherein TMA (toner mass per unit area) is 0.7 mg/cm$^2$ is formed on a full color OHP film (manufactured by Fuji Xerox Inc.), and the transmittance of the obtained sample image is measured by using a reflectance/transmittance meter HR100 (manufactured by Murakami Shikisai Gijyutsu Kenkyusho K.K.). The transmission density is obtained in accordance with the equation below, and the shielding property is evaluated based on the evaluation criteria as follows.

Shielding property (transmission density)=Log (1/total transmittance)

Evaluation criteria: Those yielding 0.25 or higher for white and 1.30 or higher for black are evaluated as good. Those yielding values lower than specified are evaluated as poor.

Evaluation of Charge value

The toners obtained are measured by using a blowoff instrument at 23° C. and 60% RH.

Evaluation of Image Quality

Initial image quality and image quality after copying 100,000 sheets (copy test) are evaluated as follows. For initial image quality, a chart having gradation of image density is copied, and the gradation. uniformity in image density. and edge effect are visually evaluated. For image quality after producing 100,000 copies, evaluation is made from the viewpoint of granularity, gradation/pseudo outline, reproducibility of image density, and other image quality defects.

TABLE 5

| | Evaluation Results | | | | |
|---|---|---|---|---|---|
| | | Charge (μC/g) | | Image quality | |
| | Shielding properties (transmission density) | Initial | After 100,000 copies | Initial | After 100,000 copies |
| Example 1 | Good | −31.2 | −29.4 | No problems | No problems |
| Example 2 | Good | −28.9 | −26.7 | No problems | No problems |
| Example 3 | Good | −42.1 | −36.6 | No problems | No problems |
| Example 4 | Good | −24.6 | −22.1 | No problems | No problems |
| Comp. Ex. 1 | Poor | −32.3 | −30.1 | No problems | No problems |
| Comp. Ex. 2 | Good | −18.2 | −10.5 | *1, *2 | — |
| Comp. Ex. 3 | Good | −17.6 | −15.5 | *2 | — |
| Comp. Ex. 4 | Good | −58.0 | −52.5 | *1, *4 | — |

*1: Fogging in background

*2: White spots on image/carrier scattering

*3: Image defects such as edge effect and pseudo outline of an image

*4: Image density loss due to insufficient development

Examples 5 and 6 and Comparative Examples 5 to 7

In accordance with Table 6 white toners are each prepared by mixing 100 parts of the toner particles and 0.6 parts of each of the fine particles as additives by using a Henschel mixer. Further according to Table 6, 6 parts each of the toners are mixed with 94 parts of the carrier to prepare a white color developer. Similarly, according to Table 6, black color toners are prepared by mixing 100 parts of the black color toner particles and 0.6 parts of each of the fine particles as additives by using a Henschel mixer According to Table 6, 6 parts each of the toners are mixed with 94 parts of the carrier to prepare a black color developer.

TABLE 6

| | Combination of toner (toner particles and additives) and carrier | | | | | |
|---|---|---|---|---|---|---|
| | White color developer | | | Black color developer | | |
| | White color toner | | | Black color toner | | |
| | Toner particles | Additive | Carrier | Toner particles | Additive | Carrier |
| Example 5 | A | A | B | D | A | B |
| Example 6 | A | B | B | D | E | B |
| Com. Ex. 5 | B | A | B | E | A | B |
| Com. Ex. 6 | C | A | B | F | F | A |
| Com. Ex. 7 | B | C | A | E | C | D |

(Evaluation)

Evaluation is performed in the same manner as in Example 1 using an electronic photocopier ("Color DocuTech60" manufactured by Fuji Xerox Inc.), by placing each of the white color developers and the black color developers in the developer unit. The results are given in Table 7.

TABLE 7

| | Evaluation Results | | | | |
|---|---|---|---|---|---|
| | | Charge value (μC/g) (White/Black) | | Image quality | |
| | Shielding properties (transmission density) | Initial | After 100,000 copies | Initial | After 100,000 copies |
| Example 5 | Good | −31.2/ −28.9 | −29.4/ −26.2 | No problems | No problems |
| Example 6 | Good | −28.9/ −25.4 | −26.7/ −24.0 | No problems | No problems |
| Comp. Ex. 5 | Poor | −32.3/ −42.1 | −30.1/ −38.7 | No problems | No problems |
| Comp. Ex. 6 | Good | −18.2/ −15.2 | −10.5/ −11.8 | *1, *2 | — |
| Comp. Ex. 7 | Poor | −20.5/ −18.2 | −18.2/ −15.0 | *1(White) *3(Black) | — |

*1: Fogging in background
*2: White spots on image/carrier scattering
*3: Image defects such as edge effect and pseudo outline of image
*4: Image density loss due to insufficient development As described above, the present invention provides a toner for developing electrostatic latent image, a developer for electrostatic latent images, a developer unit for electrostatic latent images, and a method for forming images, which generate images of high image density and high shielding properties, while minimizing image defects.

What is claimed is:

1. A toner for developing an electrostatic latent image comprising:

a white color toner particle containing at least a binder resin and a colorant, with the particle having a volume average particle diameter of no greater than 14 μm and a concentration of the colorant being 20 to 50% by weight with respect to the binder resin, wherein a ratio of white color toner particles having a particle diameter of no greater than 4 μm is 6 to 10% by number with respect to the total number of the white toner particles; and an external additive containing a hydrophobic titanium oxide article having a BET specific surface area of 40 to 250 $m^2/g$;

wherein the absolute charge value of the toner is 20 to 50 μC/g.

2. A toner according to claim 1, wherein the colorant comprises titanium oxide.

3. A toner according to claim 1, wherein the hydrophobic titanium oxide particle is obtained by a reaction of $TiO(OH)_2$ with a silane compound.

4. A toner according to claim 1, wherein the specific gravity of the hydrophobic titanium oxide particle is 2.8 to 3.8.

5. A toner according to claim 1, wherein the absolute charge value of the toner is 25 to 45 μC/g.

6. A toner according to claim 1, wherein the concentration of the colorant is 30 to 45% by weight.

7. A toner according to claim 1, wherein the volume average particle diameter of the white color toner particle is 5 to 12 μm.

8. A toner according to claim 1, wherein said white color toner particle further contains at least one of a charge control agent and an offset preventing agent.

9. A toner according to claim 1, wherein the BET specific surface area is 80 to 200 $m^2/g$.

10. A developer for electrostatic latent images, which comprises:

a toner for developing an electrostatic latent image comprising a white color toner particle containing at least a binder resin and a colorant, with the particle having a volume average particle diameter of no greater than 14 μm and a concentration of the colorant being 20 to 50% by weight with respect to the binder resin, wherein a ratio of white color toner particles having a particle diameter of no greater than 4 μm is 6 to 10% by number with respect to the total number of the white toner particles; and a carrier, with the carrier having a surface coated with a resin containing a fluororesin.

11. A developer according to claim 10, wherein electric resistance of core material of the carrier is $1\times10^{7.5}$ to $1\times10^{9.5}\Omega$.

12. A developer according to claim 10, wherein said toner further comprises hydrophobic titanium oxide particle having a BET specific surface area of 40 to 250 $m^2/g$ as an external additive.

13. A developer according to claim 10, wherein the resin coating the carrier surface contains at least one of resin particle and an electrically conductive particle dispersed therein.

14. A developer according to claim 13, wherein the resin particles comprise a thermosetting resin, and the electrically conductive particles comprises carbon black.

* * * * *